US006056380A

United States Patent [19]

Nien

[11] Patent Number: 6,056,380

[45] Date of Patent: May 2, 2000

[54] SIMPLIFIED ASSEMBLY DOCUMENT DRAWER STRUCTURE

[76] Inventor: Hsiu-Chung Nien, No. 61, Chung Mei Street, West Area, Taichung, Taiwan

[21] Appl. No.: 09/385,685

[22] Filed: Aug. 30, 1999

[51] Int. Cl.[7] ..... A47B 88/00

[52] U.S. Cl. ..... 312/348.1; 312/330.1

[58] Field of Search ..... 312/348.1, 348.2, 312/330.1, 263, 257.1, 258, 259, 348.4

[56] References Cited

U.S. PATENT DOCUMENTS

| | | | |
|---|---|---|---|
| 1,352,002 | 9/1920 | Jones | 312/348.2 |
| 1,822,448 | 9/1931 | Morin | 312/348.1 X |
| 2,281,959 | 5/1942 | Stone | 312/348.1 X |
| 3,346,318 | 10/1967 | Propst | 312/348.1 |
| 3,957,320 | 5/1976 | Walter | 312/259 X |
| 4,437,713 | 3/1984 | Roach | 312/259 |
| 5,433,518 | 7/1995 | Skov | 312/348.1 |
| 5,823,650 | 10/1998 | Lin | 312/348.1 |

FOREIGN PATENT DOCUMENTS

| | | | |
|---|---|---|---|
| 336100 | 9/1936 | Italy | 312/348.2 |
| 57368 | 12/1936 | Norway | 312/348.1 |
| 1231241 | 5/1971 | United Kingdom | 312/348.1 |

*Primary Examiner*—Peter M. Cuomo
*Assistant Examiner*—James O. Hansen
*Attorney, Agent, or Firm*—Dougherty & Troxell

[57] ABSTRACT

A simplified assembly document drawer structure comprised of a bottom panel, two side panels, and a rear panel all formed on a single pattern board. A creased section having numerous perforations is disposed along the conjoining line between the bottom panel and each side panel enabling the upward folding of the two side panels from the bottom panel, after which a front panel is added to form a document drawer. As such, not only is fabrication and assembly simple, but production costs are reduced.

2 Claims, 5 Drawing Sheets

SIMPLIFIED ASSEMBLY DOCUMENT DRAWER STRUCTURE

BACKGROUND OF THE INVENTION

1) Field of the Invention

The invention herein relates to a simplified assembly document drawer structure that is easy to fabricate and, furthermore, has a durable structure that is simple to assemble.

2) Description of the Prior Art

As indicated in FIG. 1, a conventional document drawer structure (U.S. Pat. No. 5,823,650) is comprised of a bottom panel 1, two side panels 2, a rear panel 3, and a front panel 4 and, furthermore there are fastening tabs la protruding downward from the two sides of the bottom panel 1 and the said side panels 2 each consist of a main panel 2*a* having a downward extending plate 2*b* folded from its lower section as well as the forward and rearward extending plates 2*c* and 2*d* and, furthermore, there are a number of fastening holes 2*e* formed in the downward extending plate 2*b*, forward extending plate 2*c*, and the rearward extending plate 2*d*; on the posterior aspect of the rear panel 3 are a number of fastening tabs 3*a* that correspond postionally to the fastening holes 2*e* of the rearward extending plate 2*d* with the fastening tabs 3*a* utilized to achieve the insertion into the fastening holes 2*e* of the rearward extending plate 2*d* necessary to mount the rear panel 3 between the two side panels 2; furthermore, there are two fastening tabs 4*a* situated on each of the lateral surfaces of the said front plate 4, with the fastening tabs 4*a* utilized to achieve the insertion into fastening holes 2*e* of the forward extending plate 2 necessary to mount the front panel 3 between the two side panels 2 and, furthermore, across from the rear panel 3.

Although the said structure is capable of being assembled into a document drawer, since the bottom panel 1, side panels 2, and rear panel 3 components require additional finishing and parts before final assembly is possible, which not only involves a more complex finishing process, but also more production time and, furthermore, more assembly time, therefore, the production cost tends to be higher.

In view of the foregoing situation, the inventor of the invention conducted extensive research based on many years of research and development experience in the field, which finally culminated in the development of the invention herein.

SUMMARY OF THE INVENTION

The primary objective of the invention herein is to provide a simplified document drawer stricture comprised of a bottom panel, two side panels, and a rear panel all formed on a single pattern board that only requires folding and then the insertion of a front panel to complete the assembly in a procedure that requires little time and, furthermore, reduces the production cost.

In the simplified document drawer structure provided by the invention herein, the said document drawer is comprised of a bottom panel, two side panels, a ear panel, a front panel, a reinforcement plate, and two slide rails, of which the bottom panel, the two side panels, and the rear panel are formed on a single pattern board, and the said panel board is T-shaped and flat in construction, with a creased section formed along the conjoining line between the bottom panel and each side panel as well as between the bottom panel and the rear panel and, furthermore, the said creased section has numerous perforations disposed linearly along its extent that enables the upward folding of the side panels and the rear panel into a perpendicular state with the bottom panel; furthermore, there is a predetermined number of insert fastening sections disposed lengthwise along the two side of the said bottom panel and the said insert fastening sections are pressure punched completely through the bottom panel and, furthermore, a fastening hole is formed inside; the said slide rails are positioned in parallel and a channel is formed in each and there is a catch plate extending from the inside of the said channel and, furthermore, the said catch plate is oriented lengthwise against the slide rail such that the said catch plate is inserted into the insert fastening section fastening holes, thereby enabling the mounting of the slide rail to the underside of the bottom panel; the said front panel consists of a face plate having recessed section formed inside, with panel elements situated on two sides of the opening of the recessed section and a cross plate formed at the lower ends and, furthermore, an outward facing folded section is formed along the top extent of the side panels of the said document drawer, with a notch formed in each said folded section and a square hole formed below each of the said notches such that the notches can be positioned over the panel elements, and the positioning strips extending downward from the said bottom panel can be inserted inside the said cross plate to enable the assembly of the front panel to the said document drawer, furthermore, the said reinforcement plate has a protrusion at the bottom section and a V-shaped insertion section formed at the two sides of the top end, thereby enabling the insertion of the said insertion sections into the square holes of the front panel and the mounting of the reinforcement plate tc the front panel and the said side panels.

To enable a further understanding of the technology, methods, and other functions of the invention herein as well as its objectives, structure, and innovations, the brief description of the drawings below are followed by the detailed description of the preferred embodiments.

DETAILED DESCRIPTION OF THE PREFERRED EMBODIMENTS

Figure 1:
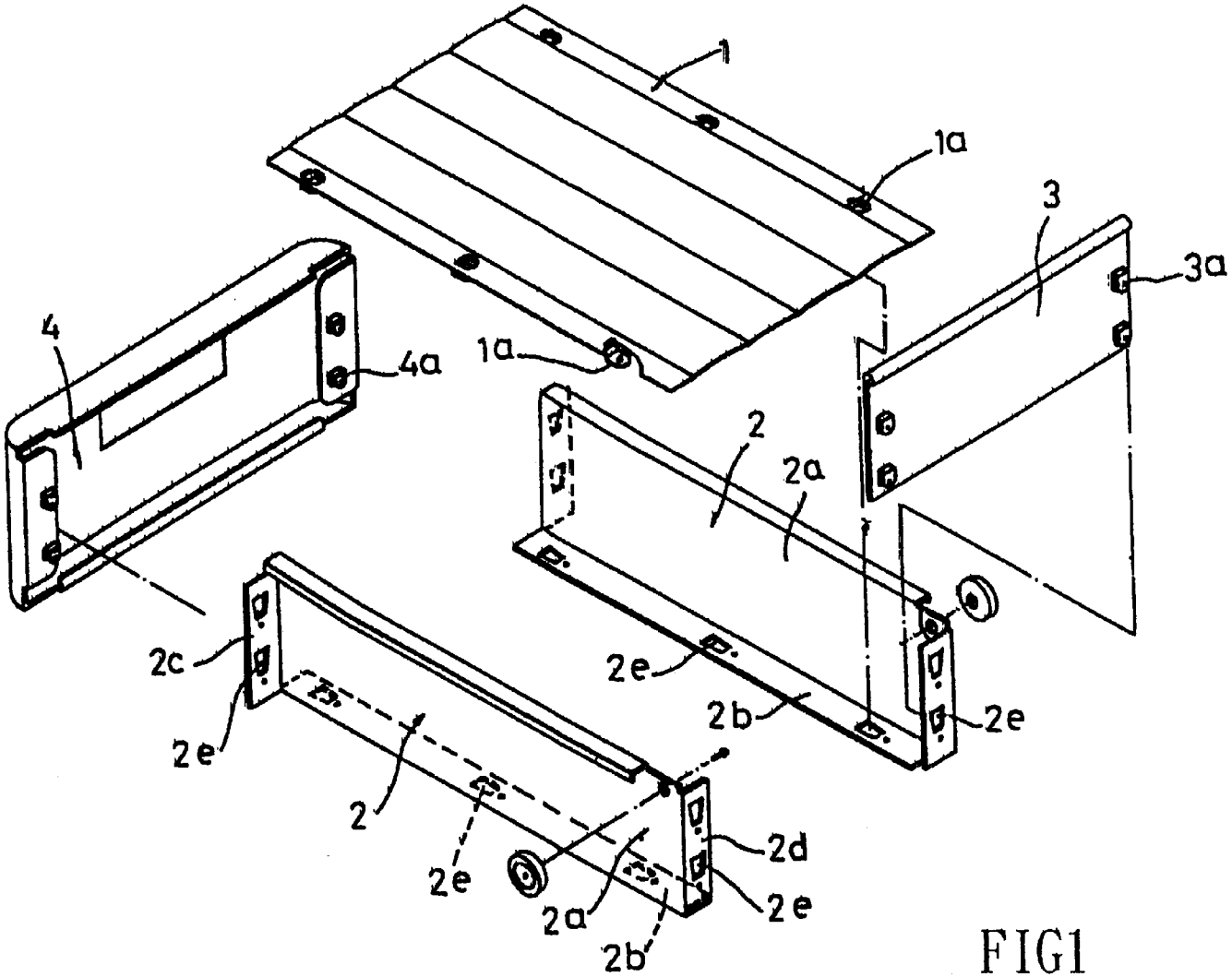
FIG1 PRIOR ART
FIG. 1 is an exploded isometric drawing of a conventional document drawer structure.
Figure 2:
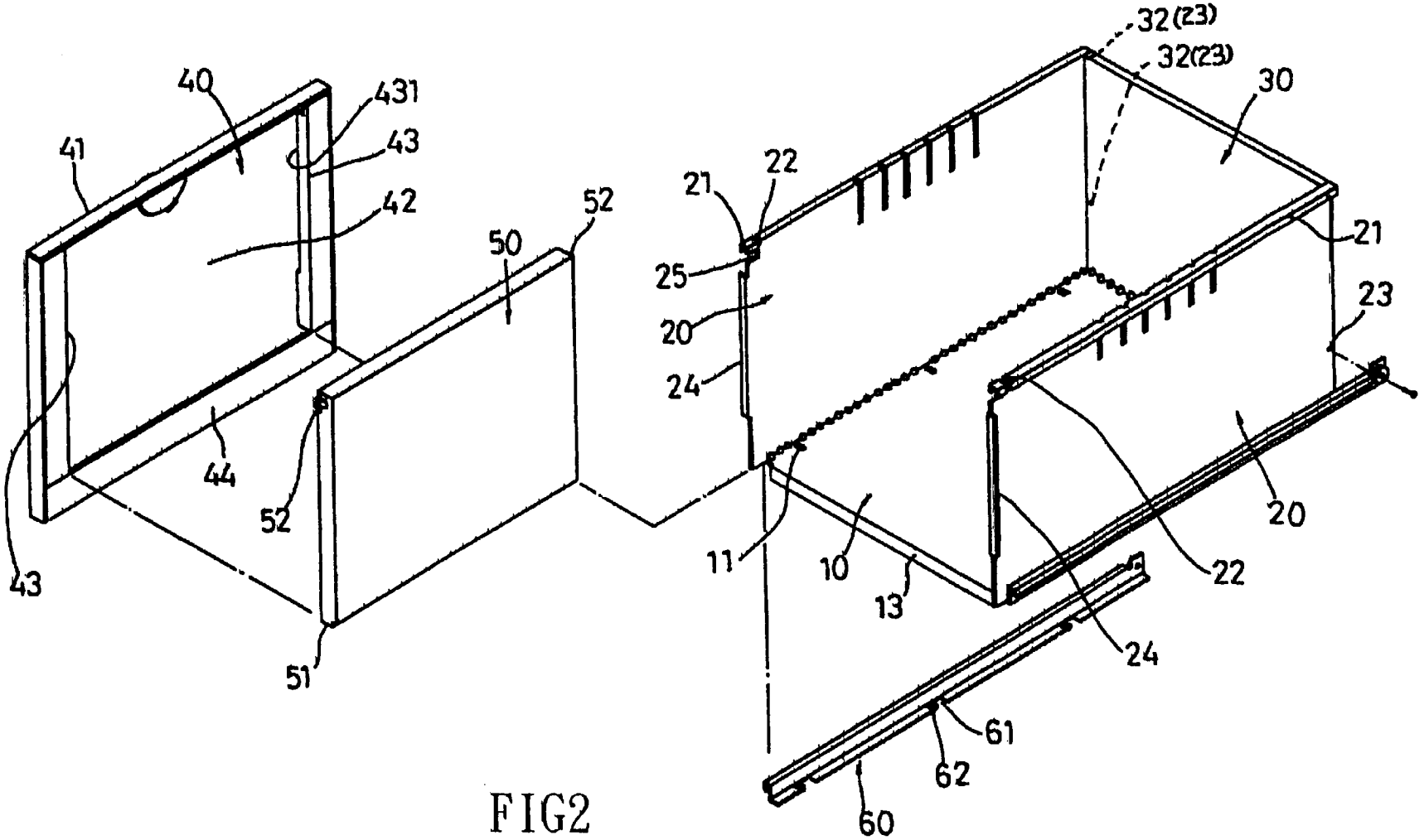
FIG. 2 is an exploded isometric drawing of the preferred embodiment of the invention herein.

Referring to FIG. 2, the preferred embodiment of the simplified assembly document drawer structure of the invention herein is comprised of a bottom panel 10, two side panels 20. a rear panel 30. a front panel 40, a reinforcement plate 50, and two slide rails 60.

Figure 3:
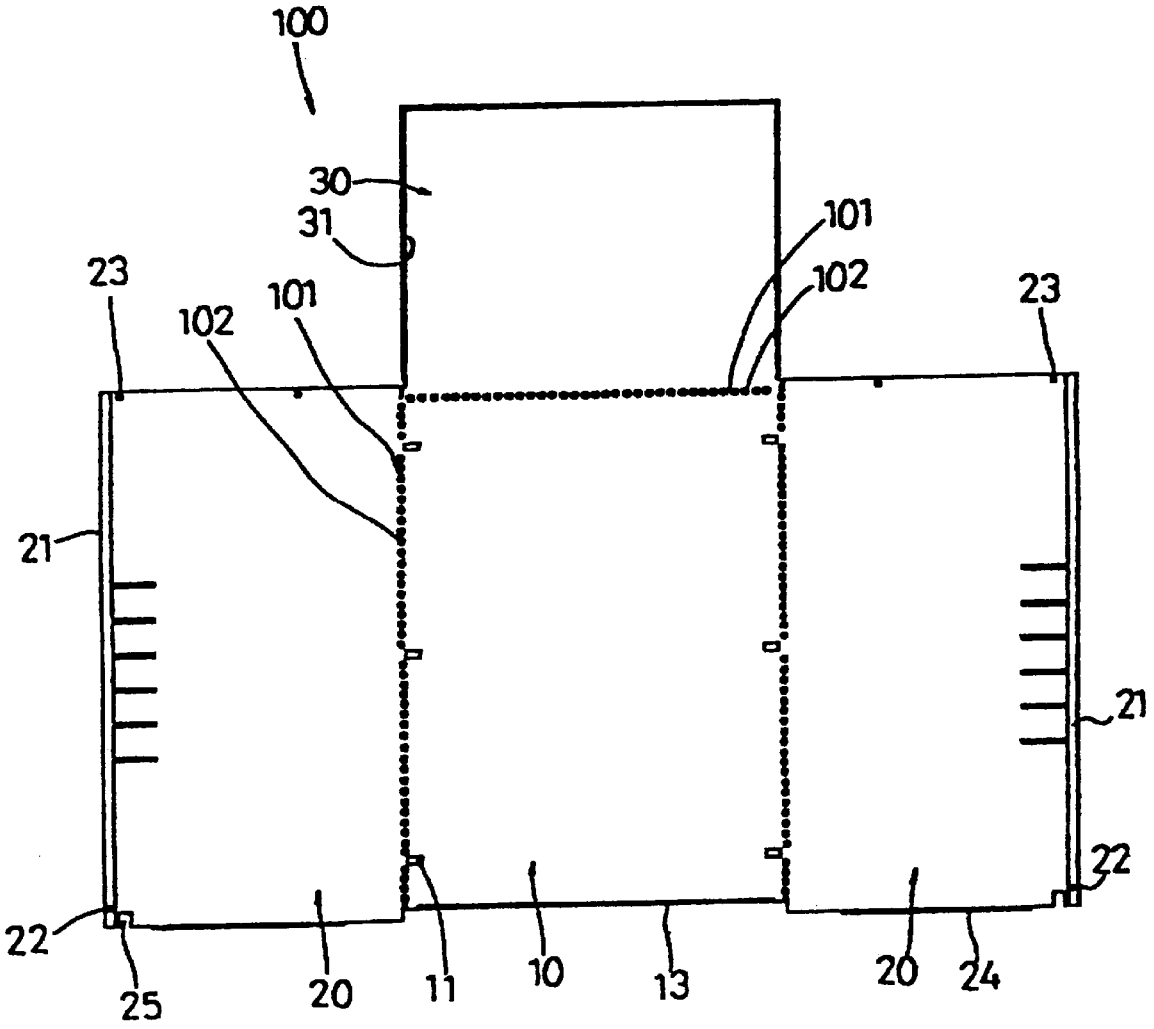
FIG. 3 is an orthographic drawing of the pattern board of the said preferred embodiment of the invention herein.
Figure 6:
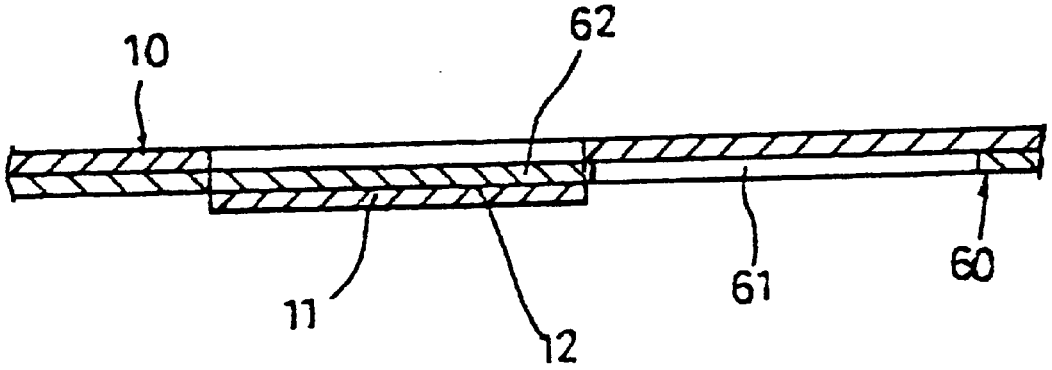
FIG. 6 is a cross-sectional drawing of the bottom panel and the slide rail of the said preferred embodiment of the invention herein.

Of which a pattern board 100. as indicated in FIG. 3, that is T-shaped and flat in construction and, furthermore, includes in its area the said two side panels 20 and the said rear panel 30 respectively situated at the three sides of the bottom panel 10, with a creased section 101 formed along the conjoining line between the bottom panel 10 and each side panel 20 as well as between the bottom panel 10 and the rear panel 30 and, furthermore, the said creased section 10 is not completely contiguous, but has numerous perforations 102 disposed linearly along its extent that enables the upward folding of the side panels 20 and the rear panel 30 into a perpendicular state with the bottom panel 10; referring to FIG. 6, there are three insert fastening sections 11 situated on each of the lengthwise sides of the said bottom panel 10 and the said insert fastening sections 11 are pressure punched completely through the bottom panel 10 and, furthermore, a fastening hole 12 is formed inside and the fastening hole 12 is situated at the lower extent of the bottom panel 190, and there is a tab 13 curving downwards from the front end of the bottom panel 10; an outward facing folded section 21 is formed along the top extent (or the outer extent before folding and forming) of each said side panel 20. with a notch 22 formed at the front end of each said folded section 21 and, furthermore two round holes 23 are formed at the rear end of each side panel 20 and an insertion edge 24 is formed at the front end of each side panel 20 and furthermore, a square hole 25 is formed below each of the said notches 22, and a folded positioning strip 31 is formed along the three sides of the rear panel 30, with a hole 32 formed in each of the two positioning strips 31 where the positioning strips 31 meet the side panels 20, which enables the positioning strips 31 to become firmly fastened to the side panels 20 and, furthermore, the alignment of the holes 32 with the round holes 23 when the rear panel 30 and the side panels 20 are folded into a perpendicular state relative to the bottom panel 10.

The said front panel 40 consists of face plate 41 having recessed section 42 formed inside, with the laterally disposed L-shaped panel elements 43 bordering the opening of the recessed section 42 configured such that small intervals 431 are formed between the inner ends of the panel elements 43 and the face plate 41, and a cross plate 44 is formed at the lower ends of the recessed section 42 that enables the fastening of the tab 13 at the front end of the bottom panel 10 to the inside of the cross plate 44 of the recessed section 42 and the engagement of the notches 22 near the front end of the folded sections 21 of the said side panels 20 over the panel elements 43 and, at the same time, the insertion of the front end of the insertion edge 24 into the intervals 431, which thereby enables the insertion assembly of the front panel 40 and the bottom panel with the side panels 20.

Figure 4:
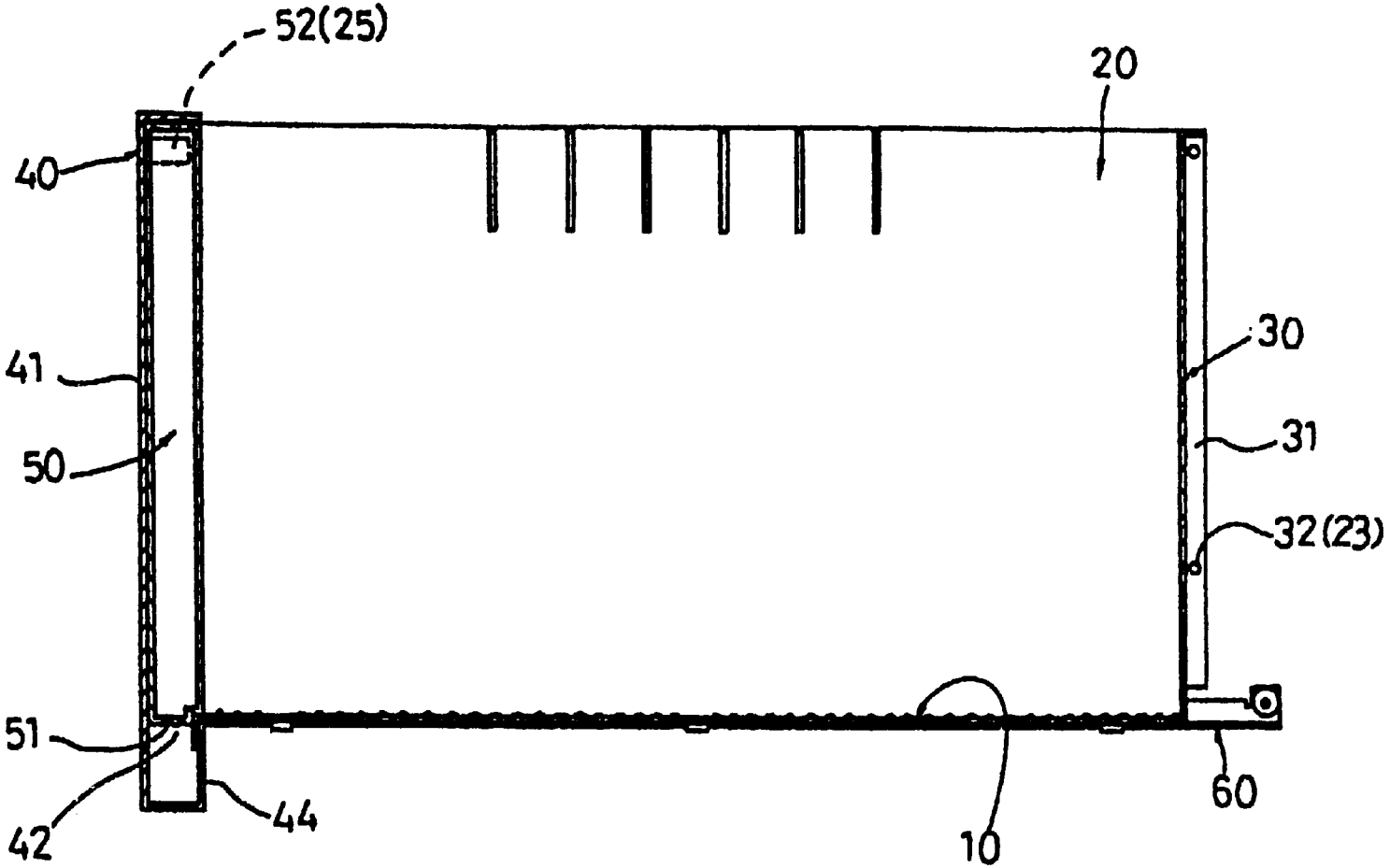
FIG. 4 is a cross-sectional drawing of the said preferred embodiment of the invention herein, as viewed from a forward perspective.
Figure 5:
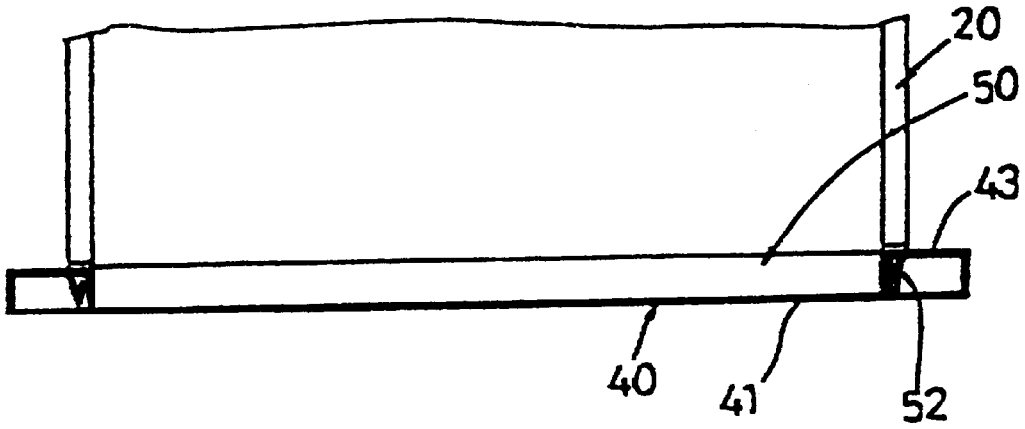
FIG. 5 is a cross-sectional drawing of the front panel, bottom panel, and reinforcing plate of the said preferred embodiment of the invention herein.

The said reinforcement plate 50, as indicated in FIG. 4 and FIG. 5, consists of hollow rectangular component of a predetermined thickness having a protrusion 51 at the bottom section, with the said protrusion 51 inserted into the recessed section 42 of the front panel 40 and, furthermore, that is positioned in between the face plate 41 and the cross plate 44 and is secured in place by the tab 13 at the front end of the bottom panel 10, and there are V-shaped insertion sections 52 formed at the two sides of the reinforcement plate 50, and the said insertion sections 52 are inserted into the square holes 25 of the front panel 20, thereby enabling the mounting of the reinforcement plate 50 inside the front panel 40.

The said two slide rails 60, as indicated in FIG. 6, are positioned in parallel against the insert fastening sections 11 of the bottom panel 10, thereby forming a channel 61 and there is a catch plate 62 extending from the inside of the said channel 61 and, furthermore, the said catch plate 62 is oriented lengthwise against the slide rail 60 such that the said catch plate 62 is inserted into the insert fastening section 11 fastening holes 12, thereby enabling the mounting of the slide rails 60 to the underside of the bottom panel 10 and, furthermore, a roller wheel 63 is installed at the final end of the slide rail 60.

With the structural details and the relative positioning of the individual components of the simplified assembly document drawer structure of the invention herein having been described in the foregoing section, the functional aspects of the invention herein and how they are effectively achieved is elaborated below.

Prior to assembly, the pattern board 100 is folded into shape by utilizing the perforations 102 provided to easily fold the two side panels 20 upward along the creased sections 101 until they are at an angle of 90 degrees relative to the bottom panel 10, causing the two side panels 20 and the bottom panel 10 to be in a perpendicular state, following which the rear panel 30 is folded up 90 degrees to add another side to the enclosure-like structure formed by the bottom panel 10 and the two side panels 20 and, furthermore, the positioning strips 31 become laterally fixed inside the side panels 20 and after the holes 32 in them are aligned with the round holes 23 of the side panels 20, screw fasteners are installed to complete the assembly of the bottom panel 10, the side plates 20, and the rear panel 30; then, with the recessed section 42 facing inward, the front panel 40 is placed at the remaining open end of the structure formed by assembled bottom panel 12, side panels 20, and rear panel 30 and, furthermore, the tab 13 of the bottom panel 10 becomes laterally positioned inside the cross plate 44 of the recessed section 42, the side panel 20 notches 22 engage the panel elements 43, and the insertion edges 24 are inserted into the intervals 431, thereby enabling the insertion assembly of the front panel 40 to the bottom panel 10 and the rear panel 20; then, after the reinforcement plate 50 is installed over the protrusion 51 and into the recessed section 42 of the front panel 40, the insertion sections 52 at top end of its two sides are inserted into the square holes 25 of the side panels 20 to complete the mounting of the reinforcement plate 50 in the front panel 40 and, furthermore, the insertion assembly of the side plates 20; finally, the catch plates 62 of the said slide rails 60 are inserted into the insert fastening section 11 fastening holes 12 of the said bottom panel 10 to mount the slide rails 50 to the two lower sides of the bottom panel 10 and, furthermore, utilizing the roller wheel 63 installed at the ends of the slide rails 60. the document drawer, which is now ready for utilization.

As such, the bottom panel 10, the side panels 20, and the rear panel 30 of the invention herein are on the said pattern board 100 and since the pattern board 100 is pressure punch fabricated with folding creases to form the majority of the components and, furthermore, after the side panels 20 and the rear panel 10 are folded up from the bottom panel 10, only four screw are utilized to fasten the rear panel 30 to the side panels 20 and to install the front panel 40, the reinforcement plate 50, and the slide rails 60 to complete the entire assembly, the production process is considerably simplified to significantly reduce the production time and minimize the assembly period and, therefore, the overall assembly cost is lowered and greater practical value is offered.

In summation of the foregoing section, since the invention herein has superior utility compared to products in the same category and such a structure was never publicly disclosed in technical publications and documents prior to its presentation the invention herein is hereby lawfully submitted for review and the granting of the commensurate patent rights.

However, the foregoing disclosure of the preferred embodiment of the invention herein shall not be construed as a limitation of the spirit and scope of the present invention and any structural modifications based on the said disclosure shall remain within the scope and claims of the invention herein.

I claim:

1. A simplified assembly document drawer structure comprising a bottom panel, two side panels, a rear panel, a front panel and slide rails installed along two sides of said bottom panel to provide tracks on which the document drawer is moved inward and outward, of which the improvements are:

a pattern board that is T-shaped and flat in construction on which is formed said bottom panel, said two side panels, and said rear panel, with a creased section having numerous linearly disposed perforations formed along a conjoining line between said bottom panel and each said side panel as well as between said bottom panel and said rear panel; positioning strips formed on sides of said rear panel enables upward folding of said side panels and said rear panel into a perpendicular state relative to said bottom panel; a tab curving downwards from a front end of said bottom panel; and an outward facing folded section formed along an outer extent of each said side panel, with a notch formed in said folded sections, and a square hole formed below each of said notches; wherein said front panel consists of a face plate having a recessed section, with panel elements situated on two sides of an opening formed by said recessed section and a cross plate formed at lower ends of said panel elements, said notches of said side panels can be positioned over said panel elements, furthermore, said tab of said bottom panel can be inserted inside said cross plate, thereby enabling the assembly of said front panel to said document drawer; wherein a reinforcement plate is installed in said recessed section of said front panel; said reinforcement plate having a protrusion at a bottom section and a V-shaped insertion section formed at two sides of a top end, thereby enabling the insertion of said insertion sections into said square holes of said side panels and the mounting of said reinforcement plate to said front panel and said side panels.

2. A simplified assembly document drawer structure according to claim 1, characterized in that a predetermined number of insert fastening sections are disposed lengthwise along two sides of said bottom panel, said insert fastening sections are pressure punched completely through said bottom panel, whereby fastening holes are formed; said slide rails are positioned in parallel and a channel is formed in each, a catch plate extends from an inside of said channel and is oriented lengthwise against each said slide rail such that said catch plate is insertable into said insert fastening section fastening holes, thereby enabling the mounting of said slide rails to an underside of said bottom panel.

* * * * *